US012601517B2

(12) United States Patent
Fedecostante et al.

(10) Patent No.: US 12,601,517 B2
(45) Date of Patent: Apr. 14, 2026

(54) ENERGY CONSUMPTION ESTIMATOR FOR BUILDING CLIMATE CONDITIONING SYSTEMS

(71) Applicant: ARISTON S.P.A., Fabriano (IT)

(72) Inventors: Francesco Fedecostante, Ancona (IT); Matteo Gianfelici, Ancona (IT)

(73) Assignee: Ariston S.P.A., Fabriano (IT)

( * ) Notice: Subject to any disclaimer, the term of this patent is extended or adjusted under 35 U.S.C. 154(b) by 345 days.

(21) Appl. No.: 18/201,159

(22) Filed: May 23, 2023

(65) Prior Publication Data

US 2023/0383976 A1 Nov. 30, 2023

(30) Foreign Application Priority Data

May 27, 2022 (IT) ..... 102022000011294

(51) Int. Cl.
*F24F 11/46* (2018.01)
*F24F 11/64* (2018.01)
(Continued)

(52) U.S. Cl.
CPC ..... *F24F 11/46* (2018.01); *F24F 11/64* (2018.01); *F24F 2110/10* (2018.01);
(Continued)

(58) Field of Classification Search
CPC ..... F24F 11/46; F24F 11/64; F24F 2110/10; F24F 2110/12; F24F 2110/20;
(Continued)

(56) References Cited

U.S. PATENT DOCUMENTS 6,216,956 B1 * 4/2001 Ehlers ..... F24F 11/62 236/47
2010/0283606 A1 11/2010 Tsypin et al.
(Continued)

FOREIGN PATENT DOCUMENTS

| | | | |
|---|---|---|---|
| CN | 107797459 | B | 3/2018 |
| WO | WO2013149210 | A1 | 10/2013 |
| WO | WO2018203075 | A1 | 11/2018 |

*Primary Examiner* — Kidest Worku
(74) *Attorney, Agent, or Firm* — Shalom Wertsberger; Saltamar Innovations

(57) ABSTRACT

A computer-implemented method for estimating the energy required for temperature control in a building. The method comprising a training phase on data from a plurality of buildings, adaptation phase to a target building, and estimation phase. The training phase comprises calculating a parameter k which summarizes the thermal characteristics of the building. Subsequently a computer based grey box model is trained with input data comprising the parameter k, indoor conditions, outdoor conditions, and energy consumed for each building. In the adaptation phase similar process is utilized for calculating the target building's the characteristic parameter k. In the estimating phase, the energy for temperature control is estimated based on the parameter k of the target building, indoor conditions, and outdoor conditions by using the computer trained mathematical model of the training phase. The temperature values used may comprise: measured or settings of indoor temperature, and measured or forecasted outdoor temperature.

18 Claims, 2 Drawing Sheets

(51) Int. Cl.

| | |
|---|---|
| *F24F 110/10* | (2018.01) |
| *F24F 110/12* | (2018.01) |
| *F24F 110/20* | (2018.01) |
| *F24F 110/22* | (2018.01) |
| *F24F 110/32* | (2018.01) |
| *F24F 130/10* | (2018.01) |
| *F24F 130/20* | (2018.01) |
| *F24F 140/60* | (2018.01) |

(52) U.S. Cl.
CPC ..... *F24F 2110/12* (2018.01); *F24F 2110/20* (2018.01); *F24F 2110/22* (2018.01); *F24F 2110/32* (2018.01); *F24F 2130/10* (2018.01); *F24F 2130/20* (2018.01); *F24F 2140/60* (2018.01)

(58) Field of Classification Search
CPC ..... F24F 2110/22; F24F 2110/32; F24F 2130/10; F24F 2130/20; F24F 2140/60; G05B 13/0265; G05B 15/02; G05B 2219/2642
See application file for complete search history.

(56) References Cited

U.S. PATENT DOCUMENTS

| | | | | |
|---|---|---|---|---|
| 2012/0259469 | A1* | 10/2012 | Ward | G05D 23/1917 700/276 |
| 2013/0190940 | A1* | 7/2013 | Sloop | G05D 23/1917 700/291 |
| 2013/0231792 | A1 | 9/2013 | Ji et al. | |
| 2014/0358291 | A1 | 12/2014 | Wells | |
| 2015/0148976 | A1 | 5/2015 | Le Pivert | |
| 2018/0238572 | A1 | 8/2018 | Murugesan et al. | |
| 2019/0158309 | A1* | 5/2019 | Park | H04L 12/2812 |
| 2020/0065445 | A1* | 2/2020 | Hoff | G06F 30/20 |
| 2021/0285671 | A1 | 9/2021 | Du et al. | |

* cited by examiner

ENERGY CONSUMPTION ESTIMATOR FOR BUILDING CLIMATE CONDITIONING SYSTEMS

This application claims priority from Italian Patent Application no. 102022000011294, filed May 27, 2022, which is incorporate herein by reference in its entirety.

FIELD OF THE INVENTION

The invention relates to the field of systems that provide a user with information on their domestic energy consumption in order to make tangible the impact of their choices and habits and raise consumer awareness.

BACKGROUND

These systems are not limited to measuring set environmental values and consumption, but have the objective of making estimates and possibly calculating and suggesting to the consumer virtuous scenarios in which energy consumption is minimised. Sometimes such systems may be configured to automatically set a temperature profile that minimises energy consumption.

In document WO18203075 A1, on the basis of a mathematical model of the home heating system, the hourly temperature setting that meets a given consumption level is identified. The system inputs are the temperatures set by the user, the outdoor temperature, the envelope heat losses and the thermal capacity of the building. Envelope heat losses and capacity are input data that an operator may set based on the characteristics of the building such as: dimensions, number of occupants, energy efficiency, geographic location. The method, therefore, requires configuration by a qualified user and is not completely automatic; moreover, the correctness of the results depends on the configuration and approximations connected to the classification method of the thermal characteristics.

Document US2013231792 A1 calculates the expected energy consumption based on occupancy hours of a building by different users and weather forecasts, and optimises the cost for heating based on the hourly cost of the energy by shifting the consumption to the times with the least cost.

Document US2015148976 A1 describes how to monitor an HVAC system to identify inefficiencies and maintenance needs. As a monitoring method it determines the line that interpolates the points given by HVAC system activation periods on one axis and temperature delta (indoor minus outdoor) over the second axis. However, readings and calculated parameters are only aimed at monitoring the correct functioning of the system.

Document US2010283606 A1 describes a system that measures the consumption for heating, and alerts the user via a display when the consumption exceeds a target consumption or a historical consumption threshold.

Document WO13149210 A1 describes a method for informing the user about the air conditioning performance; the information for the user comprises the set temperatures, the consumption and the variations in consumption between a first reference time interval and a second time interval. When a variation is detected, the system analyses the parameters to identify a possible cause; in particular, the cause may be attributed to the weather conditions, the number of occupants in the building, the hourly setting of the temperatures or manual variations made by the user. The identification of a cause is made according to a statistical method that chooses the parameter that has detected a corresponding deviation as the most probable cause. The limitation of this solution is that if the outdoor temperatures increase, and the user at the same time increases the target temperature, the system does not detect an increase in the consumptions and therefore does not report a possible waste of energy, or if the building usage decreases by 30% and the user reduces the consumption by 10%, the system does not detect an opportunity for further savings.

Document US2018238572A1 collects data from several buildings in an area to estimate the consumption need and compare it with the forecast of photovoltaic production in the same zone. It calculates characteristic parameters indicated with 1/R associated with the envelope heat losses and a thermal conductance "C" representative of the thermal capacity; the calculation is based on historical series of indoor and outdoor temperature for each building and uses the formula:

$$E_{hvac}(t) = \frac{1}{R}(T_{in}(t) - T_{out}(t)\Delta t + C(T_{in}(t) - T_{in}(t - \Delta t))$$

then it includes a configuration step to be performed on each building, where it estimates various parameters of the building.

Document US2014358291A1, starting from known outdoor environmental parameters, it learns the indoor parameters that the user considers to determine a comfort condition. The learning step is a simple storage of user indications. The document does not teach how to estimate the consumption of a building more reliably.

Document US20210285671A1 describes a complex air conditioning system for large buildings which uses a neural network dedicated to the building in order to determine the comfort conditions wherein the input to the neural network are the changes to the settings made by the users.

Document CN107797459 like the previous one describes the use of a neural network dedicated to modelling a single building to identify the comfort values of the environmental variables and calculating a control input that keeps the environmental parameters in the comfort range.

Therefore, the prior art does not teach a method for estimating the effects of the outdoor and indoor temperature on energy consumption in a reliable way for buildings of different types and that does not need a configuration step of parameters of the building.

The purpose of the present invention is to solve at least some of the known problems with a method and an apparatus for estimating energy consumption based on the characteristics of the building and on scenarios that include outdoor conditions and user settings.

In the following, "indoor and outdoor environmental variable" comprise at least the temperature, and optionally at least the humidity or wind conditions. Reference shall be made to the indoor temperature "$T_{int}$" or outdoor temperature "$T_{ext}$", meaning by these a representative value of the temperature respectively inside or outside the building, that may be a reprocessing of an actual measurements or of a forecast.

In the following, the term "building" comprises the indoor spaces, the envelope and the climate conditioning system, the indoor spaces are the set of conditioned indoor spaces, comprising both homes and office spaces or in general buildings to be conditioned; hereinafter "climate conditioning", "conditioning" or "air conditioning" shall be used interchangeably to include both heating and cooling and possibly regulation of humidity.

The letter "E" symbolizes the energy supplied to a building, "$E_{COND}$" symbolizes the energy used for climate conditioning $E_{COND}$ may comprise "$E_{ABS}$" the energy absorbed by the conditioning system and/or "$E_{HVAC}$" the energy output of the conditioning system.

The term "processor" shall be used to generally indicate at least one programmable processor able to implement the described method steps and optionally comprising, a distributed computing capacity colloquially known as cloud computing, and/or a computer and/or a microcontroller, and/or a tablet and/or smart phone.

For estimating with adequate precision the energy required for the conditioning, taking into account both the outdoor and indoor temperature, at least one finite element model would be needed that would require the knowledge of many parameters among which a 3D model of the house, relevant materials used, the trend of the weather variables, etc. The complex problem is herein simplified with a method which requires less input parameters to provide reliable estimates for the purposes.

According to an aspect of the invention the energy required for the conditioning is estimated based on the indoor and outdoor environmental variables wherein the method to build the estimator uses data collected over a large number of buildings, trains a model on these data and then adapts the model to a building to be conditioned, which may be termed a "target building" for brevity.

The advantage of the method is both in the capability to process a large number of data in the training phase and in the adaptation to a specific building, such adaption requires configuring only a limited number of characterisation parameters and, at least in some variants, does not require manual data entry for the configuration.

In particular, the model adaptation step:

is implemented on a processor;

at least according to some embodiments, it may occur without input by a user or an operator;

it requires the detection of indoor and outdoor variables (such as at least the indoor temperature $T_{int}$ and outdoor temperature $T_{ext}$) and the energy supplied to the building E. Optionally, for some operating modes additional data may be utilized.

In an aspect of the invention the proposed method comprises:

1. training a mathematical model on a large number of data comprising collected data and a calculated parameter,
2. adapting the model to a target building to be conditioned, wherein the steps include: calculating at least a characteristic parameter k of the target building,
3. using the trained model to estimate the energy required for conditioning the target building, wherein the input data of the model comprise indoor and outdoor environmental variables.

The term "training" refers to the supervised learning step of a computer implemented model.

More precisely, in an embodiment, the steps of the method comprise:

phase 1: for a plurality of buildings, collecting characterisation data averaged over a first time period the data comprising at least:

outdoor environmental variables, indoor environmental variables, energy E supplied to the building, for each building using one or more characterisation data to calculate at least one characteristic parameter k, collecting training data, averaged over a second period and comprising at least: outdoor environmental variables, indoor environmental variables, energy E that was supplied to the building to obtain the indoor environmental variables, by using the training data, training a mathematical model that outputs an estimate of the energy E to be supplied to the building and wherein the input data comprise the outdoor environmental variables, the indoor environmental variables or a value, called "comfort level", which is obtained by processing the indoor environmental variables, and the at least one calculated characteristic parameter k, phase 2 adaptation and estimation: for a target building, collecting, averaged over an initial period, characterisation data comprising at least:

outdoor environmental variables, indoor environmental variables, energy E supplied to the target building, by using the collected data from the previous step, calculating, for the target building, at least one characteristic parameter k, as it has been calculated for each building of the plurality;

estimating the energy E to be supplied to the building as an output of the mathematical model identified for the plurality of buildings, by providing as input data:

outdoor environmental variables, indoor environmental variables or the comfort level, and the at least one characteristic parameter k of the target building calculated in the previous step.

The outdoor and indoor environmental variables comprise at least the outdoor temperature $T_{ext}$, and the indoor temperature $T_{int}$, respectively.

The at least one characteristic parameter k is a quantity linked to the thermal characteristics of the envelope, the spaces and/or of the conditioning system, and/or of the method of use of the conditioning system.

The comfort level is a calculated value representative of the indoor temperature reached in the time intervals when the conditioning has been active and depends both on the indoor temperature and on the duration of such conditioning time intervals; therefore, it reflects the propensity of the user to prefer the thermal comfort over the possibility of reducing energy consumption during the data collection period.

In the method training phase the training data comprise, the outdoor environmental variables, the indoor environmental variables or a comfort level, the energy E and at least one characteristic parameter k calculated from the outdoor and indoor environmental variables and from the energy E collected in a different period.

Optionally in the method training phase the training data comprise as an alternative to the indoor variables a comfort level obtained from a pre-processing of the indoor variables.

According to the prior art, the input data for the training of a model are all chosen independently of each other to maximise the information content; instead, in the disclosed method an input for the training is the characteristic parameter k that is related to the training data and thus not independent.

The at least one characteristic parameter k, is associated with a thermal characteristic of the building. Therefore, the method may be defined as a "grey box" because, with respect to the pure training of a mathematical model, done without introducing a prior knowledge of the physical phenomenon, a partial knowledge of the physics is herein introduced.

In phase 2 the energy E to be supplied is estimated for different scenarios of indoor and outdoor environmental variables, the estimate may be communicated to the user and may be used by the user, or by the processor or by a conditioning management system to regulate the indoor environmental variables (i.e. the comfort level) consistently with a target on expenditure or energy E consumption.

Phase 1 requires data relating to a plurality of buildings, at least a few tens, preferably a few hundreds; in contrast, Phase 2 is performed on a target building to be conditioned.

A method that comprises phases 1 and 2 enables extracting information from data relating to a plurality of buildings, and use the data to model the characteristics of a target building to be conditioned; the model provides reliable estimates of the energy E to be supplied without necessarily requiring the configuration of the parameters of the building.

The characteristic parameter k represents, even with simplifications, the thermal insulation coefficient of the building.

According to some embodiments, once the energy variation between a first scenario and a second scenario different from the first by outdoor environmental variables and comfort level is known, it is possible to decouple the effect on energy of the outdoor environmental variables from that of the indoor environmental variables or of the comfort level. For this purpose, the following steps are performed:

- a fictitious intermediate scenario is determined with outdoor environmental variables equal to the first scenario and indoor environmental variables or comfort level equal to the second scenario or vice versa,
- the energy E corresponding to the intermediate scenario is estimated,
- the difference of energy E between the first and second scenario attributable to the different comfort level is calculated as the difference between the energy E of the intermediate scenario and that between the first and second scenario that differs from the intermediate scenario only by comfort level (or indoor environmental variables),
- similarly, it is possible to calculate the energy consumption difference between the first and the second scenario attributable to the various outdoor environmental variables.

DETAILED DESCRIPTION

Further features of the present invention shall be better understood by the following description of possible embodiments, in accordance with the claims and described by way of a non-limiting examples, making use of the annexed figures.

The energy needed for the conditioning of a building depends on many factors, the main ones of which may be summarized in 4 macro-groups:

a) thermal characteristics of the building (spaces, envelop heat losses, thermal capacity), b) indoor environmental variables (indoor temperature and/or temporal setting of the temperature, and optionally, humidity and/or indoor ventilation), c) outdoor environmental variables such as outside temperature and optionally humidity and/or wind conditions, d) further thermal inputs (people, household appliances, windows and doors opening).

The thermal characteristics are summarised in the at least one characteristic parameter "k".

Figure 1:
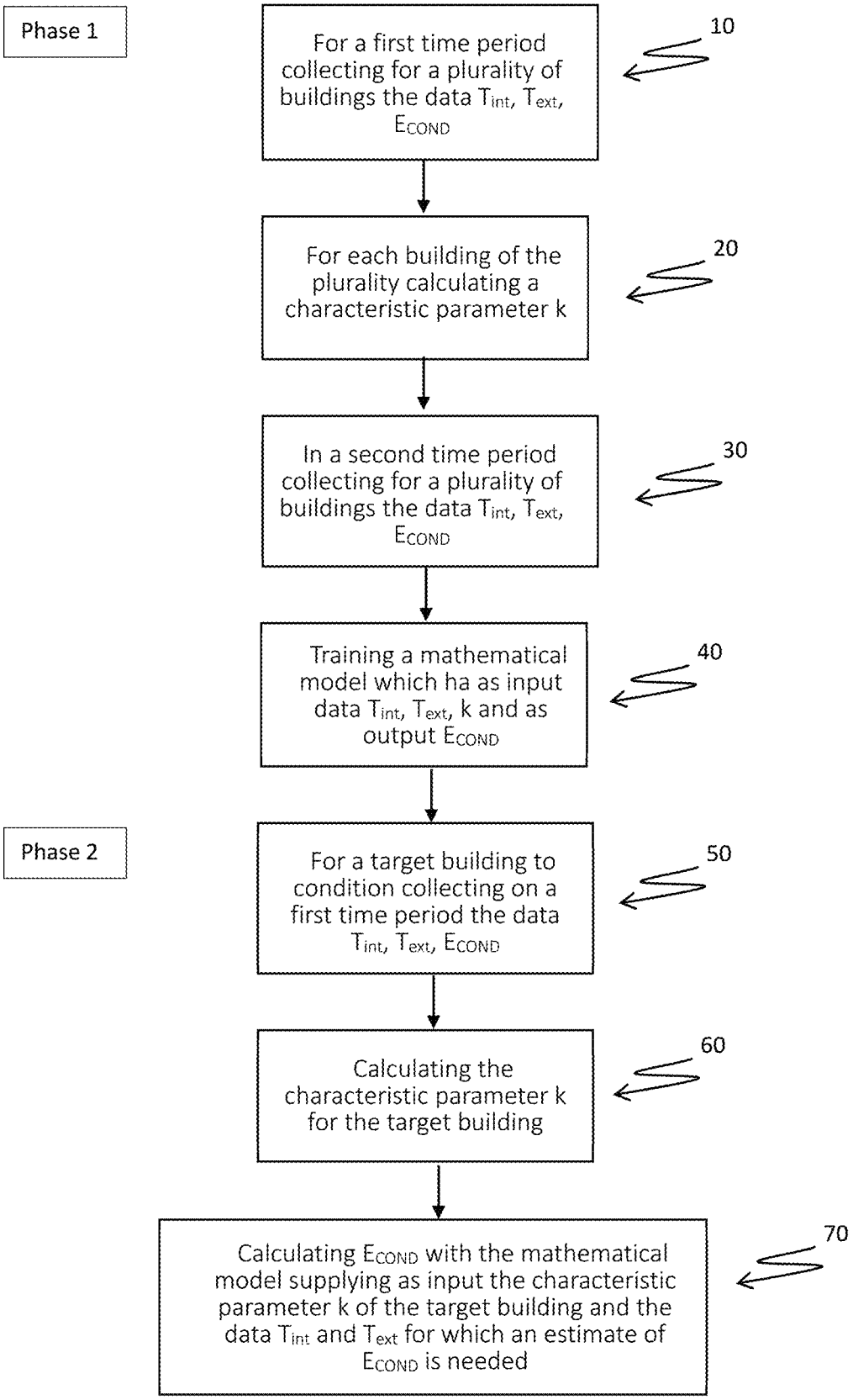
FIG. 1 shows a flowchart.
Figure 2:
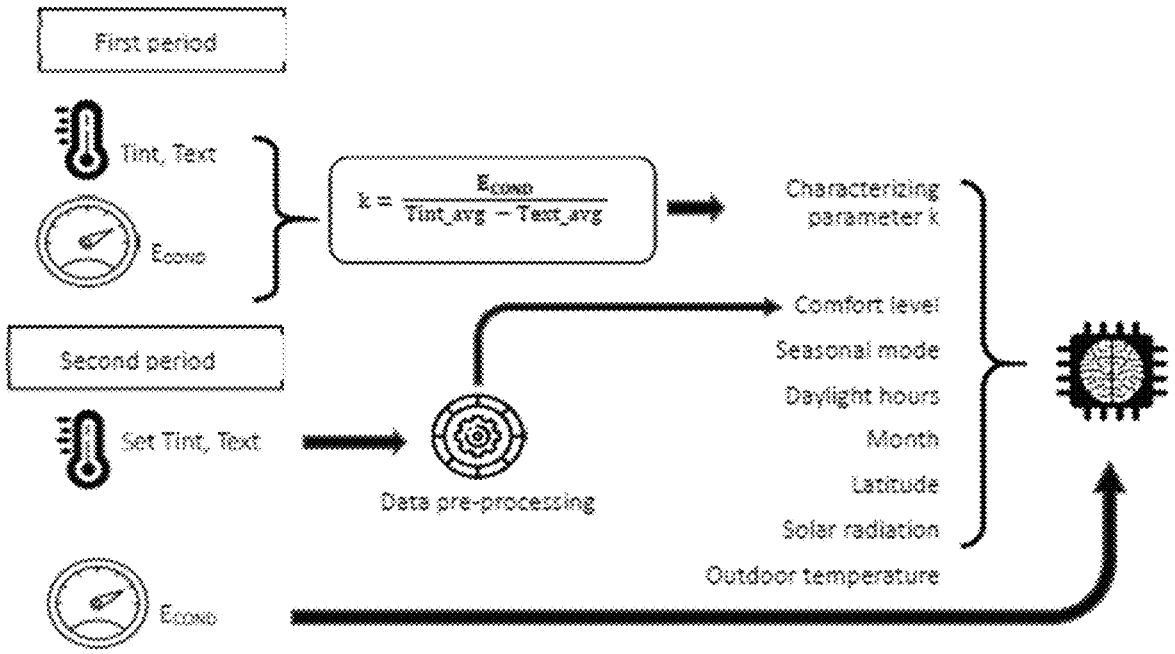
FIG. 2 shows in a graphical form a representation of the method in the training step.
Figure 3:
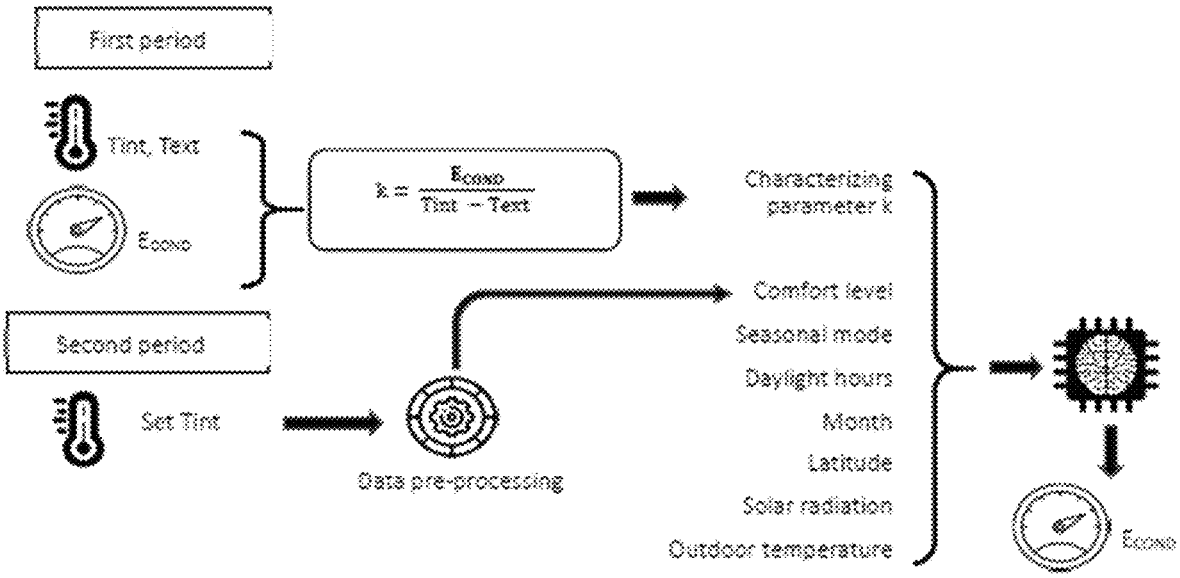
FIG. 3 shows in graphical form a representation of the method in the energy adaptation and estimation step.

The method is illustrated with the aid of the references to FIG. 1, according to a possible embodiment the method comprises the following steps:

phase 1 comprises training: for a plurality of buildings, during a first time period in which the conditioning system was at least partially active, collecting characterisation data 10 averaged over the period. The characterization data comprising: outdoor temperature $T_{ext}$, indoor temperature $T_{int}$, energy used for the conditioning E, for each building of the plurality of the buildings, using one or more respective characterisation data to calculate 20 a characteristic parameter k;

for each building of the plurality of buildings, choosing a second period wherein the air conditioning system has been active at least in part, and in the second period collecting 30:

the indoor temperature $T_{int}$ as an hourly setting or measured trend and optionally the activation time intervals of the conditioning and associating a comfort level with the indoor temperature;

the outdoor temperature $T_{ext}$ and the energy used for the conditioning E averaged over the period;

training a mathematical model that provides for each building, as an output, an estimate of the energy used for the conditioning E in the second period and has as input data at least: the outdoor temperature $T_{ext}$ and the comfort level of the second period, and the calculated characteristic parameter k.

phase 2 comprises adaptation and estimation: for a target building to be conditioned over an initial period in which the conditioning system was at least partially active, collecting characterisation data 50 comprising: outdoor temperature $T_{ext}$, indoor temperature $T_{int}$, energy used for the conditioning E and calculating 60 the characteristic parameter k of the target building;

for a time period or scenario of interest, collecting the indoor temperature $T_{int}$ as a temporal setting and/or the trend of the indoor temperature and optionally the time periods in which the conditioning system activation time intervals of the climate conditioning system for the target building has been active and associating a comfort level thereto, for a time period or scenario of interest, estimating the energy required for the conditioning E 70 using the mathematical model trained on the plurality of buildings, by providing as input data: the characteristic parameter k for the building, the outdoor temperature $T_{ext}$ and the comfort level, for the period or scenario.

The comfort level is a quantity associated with the indoor environmental variables, preferably with the temporal setting rather than with the measured values. According to a preferred embodiment, the comfort level is associated with the indoor temperature setting. Some examples of how to associate the comfort level with the indoor environmental variables shall be provided below.

Phase 1 adopts a supervised training method also called "supervised machine learning". The computer system that implements this step of the method may be a process dedicated to the building or may be provided on the cloud. For the optimisation it is possible to use a gradient boosting algorithm, or other known algorithms.

In step 1, historical series acquired on at least tens, for example at least 20, or optionally at least hundreds, for example at least 200, or preferably thousands of buildings, are selected as characterisation and training data. Data is preferably collected when the contribution of other inputs may be assumed to be negligible compared to the thermal input of the climate conditioning system; therefore, averaged values are used over selected periods for the heating processes within the colder season for the heating processes and over periods in the warmer season for the cooling processes. The plurality of buildings includes buildings located in geographical areas representative of the implementation area, and preferably comprising different types of conditioning systems, among which are boilers and heat pumps.

According to a possible embodiment in phase 1 and 2, the characteristic parameter k is calculated as a ratio of the energy provided E to the difference between the indoor $T_{int}$ and outdoor $T_{ext}$ temperature of the building for the duration of the first time period during which, the supplied energy E and the indoor $T_{int}$ and outdoor $T_{ext}$ temperatures are averaged $$P(t) = k \cdot [T_{int}(t) - T_{ext}(t)]$$

$$E = \int_{\Delta t} P(t) = k \cdot \int_{\Delta t} [T_{int}(t) - T_{ext}(t)]dt$$

$$k = \frac{E}{\int_{\Delta t} [T_{int}(t) - T_{ext}(t)]dt} = \frac{E}{\Delta t \cdot (T_{int,} - T_{ext,})}$$

Where P is the instant power supplied and E is the corresponding energy, $T_{int}(t)$ and $T_{ext}(t)$ are the indoor and outdoor temperatures in the time instant the power P is referred to. The indoor $T_{int}$ and outdoor $T_{ext}$ temperatures are an integral of the trend over time divided by the time period. The integral may be conveniently replaced with an average or with a weighted average.

According to a preferred embodiment, for the calculation of the characteristic parameter k in phases 1 and 2, the indoor temperature $T_{int}$ value is the average value as sampled over the first period.

The thermal energy of the building E is made up of energy for the conditioning system $E_{COND}$ plus energy from exogenous thermal inputs "$E_{FREE}$" (persons, household appliances, windows and doors opening):

$$E=E_{COND}+E_{FREE}$$

Optionally, the exogenous thermal inputs $E_{FREE}$ may be estimated using standard values proposed in the literature. According to a possible embodiment, the exogenous inputs may be estimated by the processor in a period in which the climate conditioning system is switched off. According to some possible embodiments, the component of the exogenous thermal inputs $E_{FREE}$ is added to the energy used for the conditioning system $E_{COND}$ to obtain the energy of the building E in the training data, and it is subtracted from the building energy E estimated by the model, to obtain only the energy used for the air conditioning system $E_{COND}$.

$$E_{COND}E-E_{FREE}$$

If an estimate for the exogenous thermal inputs $E_{FREE}$ is available, embodiments which takes them into account may be combined with the one or more other characteristics described in other embodiments.

For the objectives of the method, it is also possible to neglect the minor thermal inputs $E_{FREE}$ and to approximate the energy of the building E with the energy for the climate conditioning system $E_{COND}$:

$$E \approx E_{COND}$$

In the description, reference is made to the energy used for the conditioning $E_{COND}$ without loss of generality with respect to the possible inclusion of the exogenous thermal inputs $E_{FREE}$. Therefore, the expression "energy used for the conditioning $E_{COND}$" may be replaced with the expression thermal energy of the building E.

The energy used for the conditioning system $E_{COND}$ may be identified both with the energy absorbed by the conditioning system $E_{ABS}$ (system input) and with the thermal energy that the system exchanges with the building $E_{HVAC}$ (energy supplied or output of the system). Both approaches are possible. Between the energy absorbed by the conditioning system EARS (system input) and the thermal energy that the system exchanges with the building $E_{HVAC}$, there is the relationship:

$$E_{HVAC}=E_{ABS}*\text{eff}$$

Where eff represents the efficiency of the air condition system.

If a measure of the supplied energy $E_{HVAC}$ is used in the calculations, the characteristic parameter k is an estimate of the insulation coefficient of the building; if instead the energy absorbed by the conditioning system $E_{ABS}$ is used, the characteristic parameter "$k_{eff}$" corresponds to the insulation coefficient multiplied by the efficiency "eff" of the conditioning system. With "$k_{eff}$" specific reference is made to the characteristic parameter k multiplied by the efficiency:

$$k_{eff} = k * eff$$

$$k \approx \frac{E_{HVAC}}{\Delta t * (T_{int} - T_{ext})}$$

$$keff \approx \frac{E_{ABS}}{\Delta t * (T_{int} - T_{ext})} = \frac{E_{HVAC}}{\Delta t * (T_{int} - T_{ext})} * eff$$

For simplicity, in the following, characteristic parameter k means the result of the formula:

$$k = \frac{E_{COND}}{\Delta t * (T_{int} - T_{ext})}$$

so the same term k for the characteristic parameter is used to represent both the implementation methods in which the required energy for the conditioning $E_{COND}$ is identified with the absorbed energy $E_{ABS}$ and those in which it is identified with the supplied energy $E_{HVAC}$. The choice of using the input energy $E_{ABS}$ or the output energy $E_{HVAC}$ may be combined with one or more other characteristics described in optional embodiments.

The absorbed energy $E_{ABS}$ may be measured; the output energy $E_{HVAC}$ may be calculated starting from the absorbed energy EARS and from the efficiency eff. Alternatively, the output energy $E_{HVAC}$ may also be measured indirectly by detecting the temperature difference on the exchanger and integrating it over time utilizing known methods.

The efficiency eff of the conditioning may be considered as constant and known for heating systems such as gas boilers or electrical systems, while for heat pump systems, it is advisable to calculate the efficiency as a continuous or piecewise variable according to the temperature difference between hot source and cold source. These temperatures may be approximated to the indoor and outdoor temperature which are known. In cases where the efficiency variations are not-negligible, it is preferable to consider the energy supplied $E_{HVAC}$.

It should be noted that the following relation, $$P_{COND}(t)=k\cdot[T_{int}(t)-T_{ext}(t)]$$

is strictly valid only in stationary conditions in which there are no thermal inertia effects.

It has been found that it is very advantageous to use quantities averaged over a sufficiently long period, so that the averages reflects more closely the stationary values rather than the transitory values, in this case the effect of the thermal capacity may be neglected and it has been seen that the other characteristics of the thermal system, for the intended objects, may be represented by the characteristic parameter k.

Suitable time intervals may be, as an example, one or more days or preferably one or more weeks, or even one or more months. To obtain better accuracy, it is preferable to choose a time period Δt in which the air conditioning system has worked with a certain continuity so that the influence of the transitories is not predominant in the calculation of the average values. As an example, it has been seen that with values averaged over a month, results in line with the objectives are obtained. Therefore, in the following, each temperature value is to be understood as a value averaged in the period to which the energy for the air conditioning refers.

As stated above, the comfort level is associated with the indoor environmental variables, preferably with the temporal temperature settings rather than with the measured $T_{int}$ values. According to a preferred embodiment, the comfort level is associated with the indoor temperature settings. The association may take place through tables, rules or a calculation, and must follow the same rule for the plurality of buildings and for the target building. Increasing comfort levels are associated, in the case of heating, with increasing indoor temperatures, in the case of cooling, decreasing indoor temperatures.

By way of example, a calculation may be a weighted average of the indoor temperature set over a time period. By way of example, the time periods may be one month.

In the weighted average, preferably within the time period, a greater weight is assigned to the temperature set or detected in the time intervals in which the conditioning system is active within the period. According to some embodiments a zero weight may be assigned to the temperature set in the time intervals in which the conditioning system is not active, therefore according to some embodiments the comfort level is a weighted average of the indoor temperature $T_{int}$ set in the conditioning time intervals. Alternatively, a lower limit and an upper limit may be imposed on the indoor temperature values used to obtain the comfort level; the values beyond this limit are discarded or set equal to the limit. A lower limit may be 16° C., an upper limit may be for example 26° C.

Optionally, the comfort level is associated with a vector of indoor environmental variables comprising, in addition to the indoor temperature, also humidity or ventilation, this may be useful for a cooling system that also regulates the humidity. Without loss of generality, the comfort level may be an average of the measured or set indoor temperature $T_{int}$.

According to other possible variants, the outdoor environmental variables, in addition to the outdoor temperature $T_{ext}$ may comprise one or more of the following variables:

sunshine hours,
intensity of the sunshine,
precipitations (mm of rain or snow),
month, or week or day,
latitude,
average wind speed,
average outdoor humidity.

Advantageously, this data may be subject to a preliminary pre-processing step. It is much preferable that the data used for the estimation in phase 2, even if collected in a second period, comprise the same variables as those used for the training.

Once the model has been obtained through the training, it is appropriate to verify it according to the prior art, using part of the data collected over the plurality of buildings that has not been used for the identification as verification data; the partition between identification data and verification data being prior art.

The training data may also comprise a parameter that indicates the setting of the conditioning system, e.g. the seasonal mode.

The characteristic parameter k is not necessarily a single value for each building, if several temperature sensors inside a building are present it is possible to calculate a characteristic parameter k associated with each indoor temperature sensor. This may be done in both phase 1 and phase 2 in the adaptation step. Therefore, the simulations of the model may be replicated possibly using more values for the characteristic parameter k, each one is associated with an energy contribution and the total energy being the sum of the contributions. This may be useful if the same conditioning system operates in spaces of a building where there are different temperatures, perhaps due to indoor spaces with different dispersion properties. The choice of using a greater number of characteristic parameters k may be combined with the one or more other characteristics described in optional embodiments.

Preferably phases 1 and 2 comprise the same number of parameters k.

In the description, each reference to a characteristic parameter k may be replaced with several values of k, calculated for different measurements of the indoor temperature $T_{int}$.

The method described enables to estimate the energy required for the conditioning $E_{COND}$ as a function of outdoor temperature values $T_{ext}$ and the comfort level; by way of a non-limiting example the outdoor temperature $T_{ext}$ may be taken as the value provided by weather forecasts and the comfort level associated with the average indoor temperature $T_{int}$ set.

The estimated climate conditioning energy $E_{COND}$ may be communicated to the user providing an estimate of the expected consumptions at the time when a profile of temperatures is set.

The processor may also compare the actual climate conditioning energy with that which would have been obtained, with the same outdoor environmental variables (e.g. outdoor temperature) with different values for the comfort level.

According to a preferred implementation, the processor compares the climate conditioning energy $E_{COND}$ between two scenarios with different values both of the outdoor environmental variables and the comfort level and is able to decouple the energy variation caused by the various outdoor environmental variables from that caused by the different comfort levels. i.e., the processor may calculate the energy variation caused only by the different outdoor temperature ($T_{ext}$) and that caused only by the different comfort level. In particular, the following climate conditioning energy values $E_{COND}$ are defined:

- $Ea=f(k,w_m,u_m)$ outdoor environmental variables and comfort level of a first scenario
- $Eb=f(k,w_{m-1},u_{m-1})$ outdoor environmental variables and comfort level of a second scenario
- $Ec=f(k,w_{m-1},u_m)$ outdoor environmental variables of a second scenario, and comfort level of a first scenario
- $Ed=f(k,w_m,u_{m-1})$ outdoor environmental variables of a first scenario, comfort level of a second scenario. Where for each variable the index "m" indicates the variables relating to the first scenario and "m−1" those relating to the second scenario.
- "w" is the set of the outdoor environmental variables or weather variables that do not depend on the user and includes the same variables used for the training.
- "u" is the set of variables that determine the comfort level.

The processor may compare pairs of energy values between which only one among the outdoor environmental variables and comfort level varies, thus obtaining the influence on the energy attributable to each variable.

- "Ea−Ec" indicates the component of energy variation from the first compared to the second scenario caused by the outdoor environmental variables (weather).
- "Ea−Ed" indicates the variation component from the first of energy with respect to the second scenario caused by the different comfort level (user setting).
- "Eb−Ec" indicates how the consumption could have changed in the second scenario if the comfort level of the first scenario had been used.

According to a possible embodiment, the processor is configured to estimate the energy required with a weather scenario chosen from those of a past period or chosen from those provided for a future period and with current comfort level.

According to a further possible embodiment, the processor is configured to identify a comfort level setting which respects a maximum consumption of air conditioning energy for a given scenario of outdoor environmental variables.

The processor may provide the user with an efficiency score of the building which is represented by the characteristic parameter k. The processor may repeat the calculation of the characteristic parameter k over time, any differences may be attributed to changes in the efficiency of the conditioning system, possibly the processor may monitor the efficiency of the conditioning system and signal the need for a maintenance intervention when a new value of the characteristic parameter indicates a reduced efficiency of the building.

According to a further embodiment, it is possible to detect efficiency losses of the conditioning system by comparing the conditioning energy $E_{COND}$ actually used with an estimated one, obtained in the same scenario of outdoor environmental variables and comfort level. A discontinuous increase in the estimation error is an important indication of a loss of efficiency of the system and therefore of a possible failure.

According to a possible embodiment, the processor has access to the information relating to other buildings, and provides the user with a comparison between his/her energy consumption and that of buildings comparable or similar by characteristic parameter k or by value of the outdoor environmental variables.

If the processor in addition has also access to the geographical area in which the other aforementioned buildings are located, the processor may provide comparisons with nearby users that therefore have similar weather conditions.

The processor that implements the method may have as input means: at least sensors for receiving indoor and outdoor environmental variables and energy measurements directly detected and as output means at least those for communicating the estimated energy for the conditioning or an ideal setting profile of indoor variables.

The input or output means may provide interfaces with other devices such as for example an electronic thermostat or also the conditioning system itself for communicating set or detected temperature values or receiving target consumption values, or also user interfaces for the setting of the indoor environmental variables and/or of the maximum consumption value; the interfaces with the user may be dedicated or implemented with an application on a personal device, or can be interfaces with the cloud for receiving weather forecasts of the outdoor environmental variables, or receiving and sending data to other buildings to make comparisons. The output means may be email messages sent to the user by the cloud.

According to further possible variants, the processor may additionally or alternatively perform the following functions:

- given an hourly temperature setting and a forecast of outdoor environmental variables, calculating the consumption over a period,
- given an energy consumption target and a forecast of outdoor environmental variables, providing a setting of indoor variables that respects such target, such setting may be communicated directly to the device that controls the air conditioning system.

The invention claimed is:

1. A method for estimating energy required to a target building having a climate control system associated therewith, in order to obtain desired indoor environmental conditions based on given outdoor environmental variables, the method comprising:

in a training phase:

a) for each of a plurality of individual buildings, each having a climate control system associated therewith, collecting and averaging building-specific characterization data over a first time period ($T_1$), the characterization data comprising outdoor environmental variables, respective indoor environmental variables, and the energy supplied to the respective individual building, the climate conditioning system being active during at least a portion of the first time period ($T_1$);

b) for each individual building, utilizing one or more building-specific characterization data to calculate at least one individual building-specific characteristic parameter (k), the parameter (k) being calculated utilizing at least outdoor and indoor environmental variables and energy supplied to the respective individual building;

c) for each of the plurality of individual buildings, collecting building-specific training data over a second time period ($T_2$), the training data comprising outdoor environmental variables, respective indoor environmental variables, and the energy supplied to the respective individual building over the second time period ($T_2$), the climate conditioning system being active during at least a portion of the second time period ($T_2$);

d) using a computer system capable of executing a grey-box type artificial intelligence software, training a single mathematical model of a building using aggregated building-specific training data collected from the plurality of individual buildings to output an estimate of the energy supplied to each individual building in the second time period ($T_2$), the model being responsive to input data obtained at the second time period ($T_2$), the input data comprising for each building of the plurality of buildings, outdoor environmental variables, and indoor environmental variables, and the respective building-specific characteristic parameter (k);

in an adaptation phase:

e) for the target building, collecting and averaging target building characterization data over a third time period ($T_3$), the target building characterization data comprising outdoor environmental variables, respective indoor environmental variables, and the energy supplied to the target building, the target building climate conditioning system being active during at least a portion of the first time period ($T_3$);

f) for the target building, utilizing one or more target building characterization data to calculate a target building characteristic parameter (k) in the same manner as done for the calculation of building-specific characteristic parameter (k) in step b);

in one or more estimation phases:

g) utilizing the grey-box type artificial intelligence software as used in step d), estimating energy ($E_{target}$) to be supplied to the target building using the mathematical model of step d) by supplying thereto a value representative of targeted indoor environmental conditions, the target building characteristic parameter (k), and measured, estimated, and/or forecasted outdoor environmental variables; and, h) communicating to a user output device the estimated energy ($E_{target}$) to be supplied.

2. A method as claimed in claim 1, wherein the training phase comprises a step of utilizing collected training data determining a comfort level for each individual building, the comfort level being related to the indoor environmental variables of the respective building and wherein in step d) the input data obtained at the second time period ($T_2$), comprise the comfort level and in step g) the value of indoor environmental conditions is the comfort level.

3. A method as claimed in claim 1, wherein the indoor environmental variables are one or more variables selected from indoor temperature ($T_{int}$), desired internal temperature setting, trends of the internal temperature ($T_{int}$), operating intervals of the respective building climate conditioning system, indoor relative humidity, indoor ventilation, or any combination thereof.

4. A method as claimed in claim 1, wherein the outdoor environmental parameters are one or more variables selected from outdoor temperature ($T_{ext}$), outdoor relative humidity, wind direction, wind speed, time of day, period of the year, outdoor temperature trends, sunshine hours, intensity of the sunshine, precipitations (mm of rain or snow), month, or week or day, latitude or any combination thereof.

5. A method as claimed in claim 1, wherein the building-specific and target building characteristic parameter (k) are a function of the average of indoor temperature ($T_{int}$) measured in the respective building during a first time period.

6. A method as claimed in claim 1, wherein the building-specific and target building characteristic parameter (k) are a function of the energy supplied to the respective building, divided by the difference between the respective averaged indoor ($T_{int}$) and average outdoor ($T_{ext}$) temperature for the building.

7. A method as claimed in claim 6, wherein the building-specific and target building characteristic parameter (k) is calculated according to the formula $$k = \frac{E}{\Delta t \cdot (T_{int} - T_{ext})},$$

where ($T_{int}$) and ($T_{ext}$) are, respectively, averaged values of the indoor temperature and outdoor temperature over a time period ($\Delta t$), in which the indoor temperature and outdoor temperature and, the supplied energy E, are collected.

8. A method as claimed in claim 2, wherein the comfort level is associated with a weighted average of temporal settings of the indoor temperature ($T_{int}$) for the individual building, and/or the target building.

9. A method as claimed in claim 2, wherein the comfort level is a weighted average of the temporal settings of indoor temperature ($T_{int}$) in the time intervals where the climate conditioning system is active.

10. A method as claimed in claim 9, wherein the values of the indoor temperature ($T_{int}$) for calculating the comfort level which are beyond a lower limit and an upper limit are discarded or set equal to the upper or lower limit.

11. A method as claimed in claim 1, wherein the plurality of individual buildings comprises at least 20 individual buildings.

12. A method as claimed in claim 1 wherein given two sets of values for the target building each comprising an energy provided to the building (E1), (E2), given indoor environmental variables (IV1) and (IV2) different from each other and given outdoor environmental variables (OV1) and (OV2) different from each other, the method comprises:

a. estimating the energy (E12) to be provided to the building corresponding to indoor environmental variables of the first set (IV1) and to outdoor environmental variables of the second set (OV2);

b. calculating a change in energy chosen from an energy change due to the change in indoor environmental variables as (E2-E12) or an energy change due to the change in outdoor environmental variables as (E1-E12).

13. A computer system comprising a readable non-volatile memory containing program steps that when executed by the computer system, causes the computer system to perform at least the following steps:

in a training phase:

a) for each of a plurality of individual buildings, each having a climate control system associated therewith, collecting and averaging building-specific characterization data over a first time period ($T_1$), the characterization data comprising outdoor environmental variables, respective indoor environmental variables, and the energy supplied to the respective individual building, the climate conditioning system being active during at least a portion of the first time period ($T_1$);

b) for each individual building, utilizing one or more building-specific characterization data to calculate at least one individual building-specific characteristic parameter (k), the parameter (k) being calculated utilizing at least outdoor and indoor environmental variables and energy supplied to the respective individual building;

c) for each of the plurality of individual buildings, collecting building-specific training data over a second time period ($T_2$), the training data comprising outdoor environmental variables, respective indoor environmental variables, and the energy supplied to the respective individual building over the second time period ($T_2$), the climate conditioning system being active during at least a portion of the second time period ($T_2$);

d) using a computer system capable of executing a grey-box type artificial intelligence software, training a single mathematical model of a building using aggregated building-specific training data collected from the plurality of individual buildings to output an estimate of the energy supplied to each individual building in the second time period ($T_2$), the model being responsive to input data obtained at the second time period ($T_2$), the input data comprising for each building of the plurality of buildings, outdoor environmental variables, indoor environmental variables, and the respective building-specific characteristic parameter (k);

in an adaptation phase:

e) for the target building having a climate conditioning system, collecting and averaging target building characterization data over a time period ($T_3$), the target building characterization data comprising outdoor environmental variables, respective indoor environmental variables, and the energy supplied to the target building, the target building climate conditioning system being active during at least a portion of the first time period ($T_3$);

f) for the target building, utilizing one or more target building characterization data to calculate a target building characteristic parameter (k) in the same manner to the calculation of building-specific characteristic parameter (k) in step b);

in one or more estimation phases:

g) utilizing the grey-box type artificial intelligence software as used in step d), estimating energy ($E_{target}$) to be supplied to the target building using the mathematical model of step d) by supplying thereto a value of indoor environmental conditions, the target building characteristic parameter (k), and measured, estimated, and/or forecasted outdoor environmental variables; and, h) communicating to a user output device the estimated energy ($E_{target}$) to be supplied.

14. A computer system as claimed in claim 13, wherein the computer system comprises a distributed computer system having a plurality of processors, wherein one or more of the plurality of processors are configured to execute any of the steps or a portions thereof.

15. A computer system as claimed in claim 14, wherein at least two of the processors of the plurality of processors are in data communication with one another, forming a distributed processor system.

16. A computer system as claimed in claim 15, wherein the steps from a) to d) are executed by a first processor or a first group of processors and at least part of the steps f), g) or h) are executed by a second processor or a group of processors, the first and the second processors or groups of processors being in data communication with one another.

17. A distributed processor system as claimed in claim 16 wherein the second processor is chosen between a smart phone or a tablet.

18. A computer system as claimed in claim 16, wherein the first group of processors and the second group of processor share at least one processors therebetween.

* * * * *